United States Patent [19]

Ricci

[11] Patent Number: 4,740,213

[45] Date of Patent: Apr. 26, 1988

[54] METHOD OF PRODUCING A RANDOM FADED EFFECT ON CLOTH OR MADE-UP GARMENTS, AND THE END-PRODUCT OBTAINED BY IMPLEMENTATION OF SUCH A METHOD

[75] Inventor: Francesco Ricci, Poggio Berni, Italy

[73] Assignee: Golden Trade S.R.L., Bologna, Italy

[21] Appl. No.: 921,947

[22] Filed: Oct. 22, 1986

[30] Foreign Application Priority Data

Mar. 28, 1986 [IT] Italy ..... 3376 A/86

[51] Int. Cl.[4] ..... D06L 3/06

[52] U.S. Cl. ..... 8/108.1; 252/187.25; 252/187.26

[58] Field of Search ..... 8/108.1, 137; 427/242, 427/212, 220; 252/186.2, 186.25, 186.27, 174.13, 91, 95, 187.24, 187.25, 187.26

[56] References Cited

U.S. PATENT DOCUMENTS

| | | | |
|---|---|---|---|
| 1,533,917 | 4/1925 | Kaiser | 8/101 |
| 3,650,673 | 3/1972 | Ehner et al. | 8/137 |
| 3,945,936 | 3/1976 | Lucas et al. | 252/95 |
| 4,130,392 | 12/1978 | Diehl et al. | 8/111 |
| 4,218,220 | 8/1980 | Kappler et al. | 8/102 |
| 4,243,391 | 1/1981 | Puchta et al. | 8/111 |
| 4,391,723 | 7/1983 | Bacon et al. | 252/90 |
| 4,575,887 | 3/1986 | Viramontes | 8/158 |
| 4,601,845 | 7/1986 | Namnath | 252/99 |

FOREIGN PATENT DOCUMENTS

| | | | |
|---|---|---|---|
| 3217188 | 10/1983 | Fed. Rep. of Germany . | |
| 2517710 | 6/1983 | France . | |
| 0001460 | of 1873 | United Kingdom | 8/137 |
| 2118463 | 11/1983 | United Kingdom . | |

OTHER PUBLICATIONS

Newsweek, Sep. 22, 1986.
Legler Typewritten Flyer, 7/3/82.
Legler Typewritten Flyer, 9/1986.

*Primary Examiner*—R. Lionel Clingham
*Assistant Examiner*—John F. McNally
*Attorney, Agent, or Firm*—Stiefel, Gross & Kurland

[57] ABSTRACT

In the method disclosed, cloth to be faded is brought into dry contact with pumice granules that are impregnated with a chemical bleaching agent such as a hypochlorite; the action takes place in a conventional process machine, the drum of which is rotated for a preset duration.

20 Claims, 4 Drawing Sheets

FIG. 3
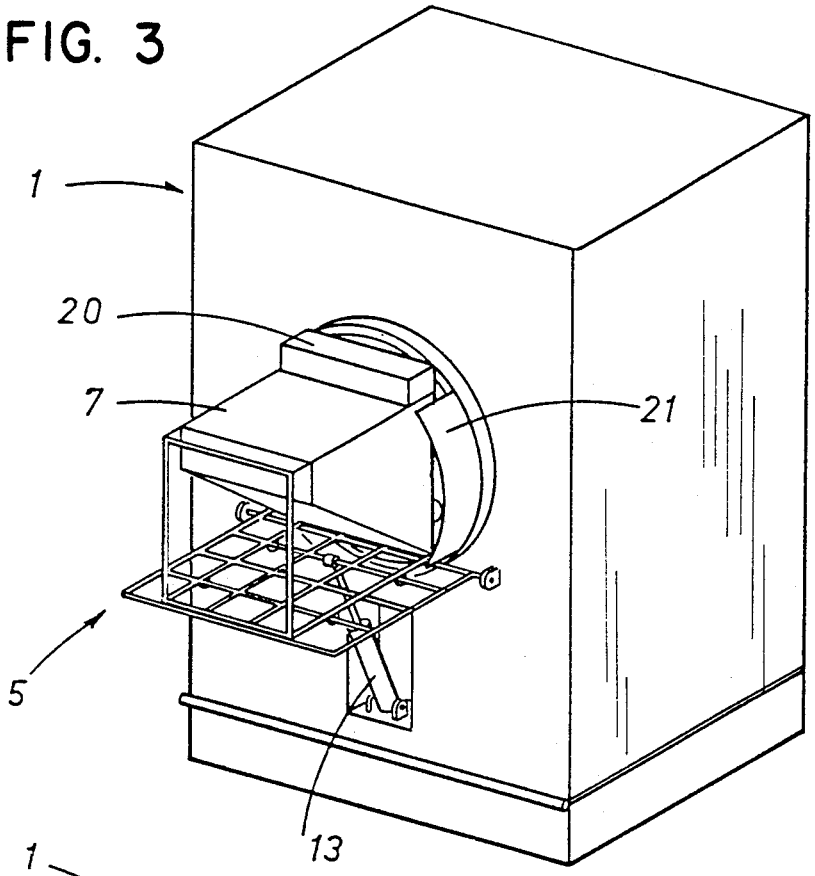
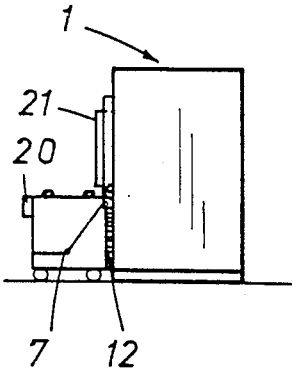
FIG. 2
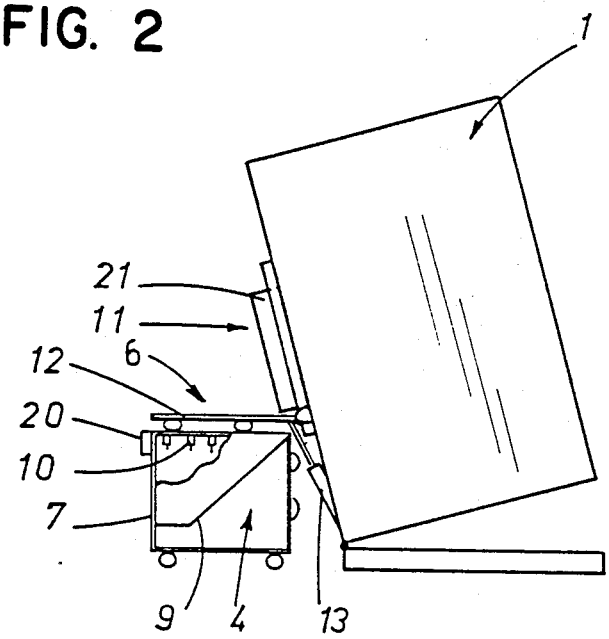
FIG. 4

METHOD OF PRODUCING A RANDOM FADED EFFECT ON CLOTH OR MADE-UP GARMENTS, AND THE END-PRODUCT OBTAINED BY IMPLEMENTATION OF SUCH A METHOD

BACKGROUND OF THE INVENTION

The invention relates to a method of producing a random faded effect on cloth, whether bulk fabric or made-up garments, and to the end-product obtainable by means of its implementation.

There is constant effort expended in certain fields of the present-day clothing industry, on the creation of a "used", or faded look, a trend which is most noticeable in the case of garments fashioned from denim cloth.

The effect is produced in most instances by employing salts of hypochlorous acid, that is, hypochlorites. The salt most commonly used is sodium hypochlorite, made either by passing chlorine into sodium hydroxide solution, or by subjecting sodium chloride to electrolysis. Hypochlorites in solution (generally at between 0.2 and 0.5%) are widely used as bleaching agents, particularly in the textile industry, as the strong oxidizing properties of the C1O-anion provide a powerful whitener.

Hypochlorite solutions, in their familiar forms of Javelle water, proprietory household bleach and disinfectant products etc., are similarly in widespread use as laundering aids both in the trade and domestically. Such substances permit of producing a uniform bleaching action on fabrics and garments, the end-result of which will be more or less discernable according to its duration.

Subsequently, the trend has been toward a look featuring random faded effects.

One such manifestation of this trend is the practice of stone-washing—i.e. immersing cloth in water containing no other substance than pumice. The effect it is sought to produce on denim treated by this method is one of natural fading, a "used" look characterized by the contrast between light and dark areas; in made-up garments however, the effect tends to appear on and around the seams only, whereas the color of the remaining fabric remains substantially uniform.

Attempts have been made to produce a more authentic look, using the same stone-washing method and adding sodium hypochlorite. Whilst it is true that advantageous cuts in process time have been enabled by adopting such an expedient, the end-result is much the same as that of the original stone-wash, with the fade confined to the seams of the garment.

Accordingly, the object of the method disclosed is that of producing a random faded effect on fabrics or made-up items of clothing, the essential feature of which is the appearance of a plurality of irregular patches that vary in intensity of color shading and are distributed in a non-uniform manner over the entire expanse of the cloth, or garment.

SUMMARY OF THE INVENTION

The stated object is realized by implementation of the method disclosed, which comprises the steps of bleaching the cloth in dry state, utilizing granules of pumice or similar material impregnated with a fluid having powerful bleaching properties and tumbling granules and cloth together in a rotating drum such that close contact is brought about between the two, then recovering the granules following rotation of the drum for a set duration, and neutralizing any residual bleaching agent held in the cloth by washing and drying.

According to the invention, the sequence of operations in which the granules are recovered and the residual bleaching agent neutralized may be implemented either as stated, or in reverse order.

Utilizing granulated pumice of sufficient roughness with a texture such as will permit high absorption of a powerful bleaching agent (e.g. hypochlorite), and running the machine dry for a given period of time commensurate with the type of appearance and the strength of the cloth required, one produces a dual fading action: mechanical, inasmuch as the coarse surface of the pumice granules performs an abrasive action on the fibres of the cloth; and chemical, produced by the bleaching agent with which the granules are impregnated.

According to the method disclosed, bleaching occurs only on those areas of the cloth in contact with the pumice granules, and one thus obtains an random faded effect over the extire expanse of the cloth in process, whether in bulk or made up already into garments.

BRIEF DESCRIPTION OF THE DRAWINGS

The invention will now be described in detail, by way of example, with the aid of the accompanying drawings, in which:

FIG. 2 is the side view of equipment utilized in the method's implementation, seen in a first typical operating position;

FIG. 3 is a perspective of the equipment illustrated in FIG. 2, seen in a second typical operating position;

FIG. 4 is further a side view of the equipment illustrated in FIG. 2, seen in a third typical operating position;

DESCRIPTION OF THE PREFERRED EMBODIMENT

In terms of fundamental concepts, it can be asserted safely that the artificial fading of cloth has been accomplished conventionally hitherto by adopting chemically aggressive and, where pumice has been used, mechanically aggressive production media. What is more, the chemically aggressive effects as produced, say, by sodium hypochlorite, have remained within certain limits by reason of the fact that the chemical must necessarily be diluted in the water with which the process machine is filled.

By contrast, the method disclosed envisages a combined chemically and mechanically aggressive action the results of which are highly effective.

Figure 1:
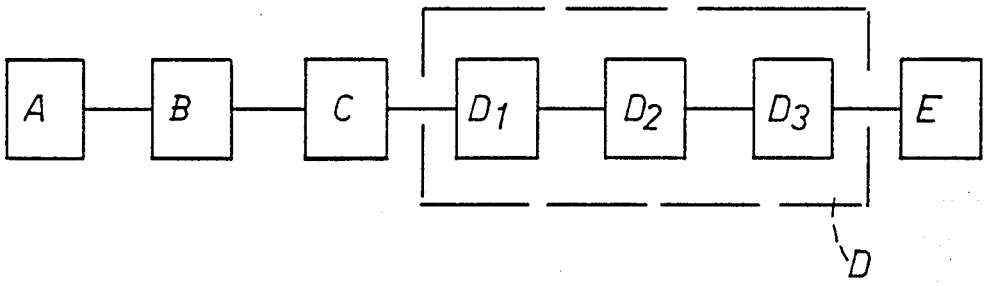
FIG. 1 is a block diagram illustrating an overall fading process, comprising the steps of the method disclosed, and steps which might precede those of the method.

Before being subjected to the fading process proper, cloth may undergo conventional treatment as indicated in FIG. 1, whether as bulk fabric pure and simple, or already made up into garments. A denotes pressing, B denotes softening by being put to soak in hot water (50°-60° C.), and C denotes drying; all three operations would be carried out using standard production media. The fourth stage, denoted D, is divided substantially into three steps D1, D2 and D3, and it is these that constitute the essential subject matter of the disclosure.

In step D1, granules 2 of a permeable substance are impregnated with a powerful bleaching agent; the granules are coarse, and will ensure a particularly high rate of absorption provided that the bleaching agent is liquid. Step D2 indicates placing of the bleach-impregnated granules 2 in the rotating drum 1*a* of the process machine 1, which will be run dry for a given period of time that is dependent in practice upon the mechanical properties of the cloth and the desired fade effect, (approximately 5 minutes, in the applicant's experience).

Step D2 being completed, one has implementation of step D3, which is that of recovering the granules 2, or alternatively, disposing of them.

The granules 2 may be obtained from common pumice, and a medium possessing powerful bleaching properties might be ordinary sodium hypochlorite, though the field of choice is by no means limited to these two substances.For instance, the granules 2 could be formed from a coarse paper-based material, and thus dissolved once its mechanical and chemical action has been performed, either by flooding the self-same drum of the process machine 1 with water once the fading cycle is terminated, or transferring the contents of the drum to another machine installed in line with the process machine. Adopting this particular expedient, the granules can be disposed of rather than recovered, though clearly enough, the adoption of pumice renders recovery desirable since the granules can be newly impregnated with a fresh supply of bleaching agent and re-used in subsequent cycles of treatment.

Block E in FIG. 1 denotes a further stage in which residual traces of the bleaching agent held in the cloth (sodium hypochlorite, or whatever) are neutralized; this would be brought about, utilizing hydrogen peroxide for instance, by a normal wash-soak-and-dry sequence.

Practical experiment has revealed that when a suitable quantity of coarse, bleach-impregnated granules, say, pumice stones, are placed in the rotary process machine during stage D, the combination of a singularly high capacity for mechanical and chemical aggression, coupled with the dry and random contact brought about between cloth and stones, is such as to permit of obtaining sharp differences in color shading at the areas where contact occurs. At all events, the overall faded effect produced on the fabric or the made-up garment appears non-uniform, irregular.

The method disclosed can be implemented by means of a machine 1 with a rotating drum, that may be tilted forward (see FIG. 4) to the end of dumping the cloth or garments 3 from its loading hatch 11, and is used in conjunction with an item of auxiliary equipment that occupies at least three stations: a first denoted 4, at which granules 2 are collected and impregnated, a second denoted 5, from which the impregnated granules 2 are discharged into the drum 1*a*, and a third denoted 6, serving for recovery or disposal of the granules 2 following each cycle. The three stations, which in effect are the typical operating configurations assumed by the machine and the equipment, are illustrated in FIGS. 2, 3 and 4 respectively.

The equipment consists substantially in a simple structure comprising a bin 7 having an open top 8 and at least one side 9 set at a raked angle. In a preferred embodiment, the bin 7 will be fitted with nozzles 10 from which sodium hypochlorite contained, say, in a tank-and-pump unit 20 fitted to the bin, can be sprayed at the granules. The bin 7 moves from a first, lowered position in which the machine 1 stands upright (the first station 4 illustrated in FIG. 2) to a second, raised position (the second station 5 illustrated in FIGS. 3 and 6) in which the structure is rotated so that the raked side 9 of the bin is angled downward and toward the hatch 11 of the machine in order that the granules 2 may be discharged into the drum 1*a* containing the cloth or garments 3 to be faded.

From the second position, the bin 7 is once again lowered to the third and last position (see FIGS. 4 and 5), in which the machine 1 is tilted forward to the end of dumping the faded cloth and, if appropriate, the granules 2.

Rotational movement of the bin 7 is produced by a conventional actuator 13, which in the embodiment illustrated is a fluid power cylinder.

In the event of the granules 2 being recovered, and thus requiring separation from the cloth, the equipment will comprise a riddle 12, hinged to the frame of the process machine 1 and operated by the actuator 13. In a preferred embodiment, the riddle 12 can be attached both to one side of the bin 7 and across its open top 8 (see FIGS. 3 and 4). With the side of the bin 7 hooked over the riddle 12, the riddle itself serves to support the bin 7, with its charge of granules 2, during impregnation and upward rotation toward the second, or discharge position (see FIG. 3) from where the granules will ultimately roll down through the hatch 11 of the machine 1 and into the rotating drum 1*a*. With the riddle 12 then positioned over the open top 8 of the bin (FIG. 4), one is provided with a grille through which granules separated from the cloth or garments 3, post cycle, can drop into the bin. These same granules will then be re-impregnated with sodium hypochlorite and used in the next cycle. It will be seen that the hatch 11 of the machine 1 is provided with surrounds 21 to assist passage of the granules and the cloth.

Figure 6:
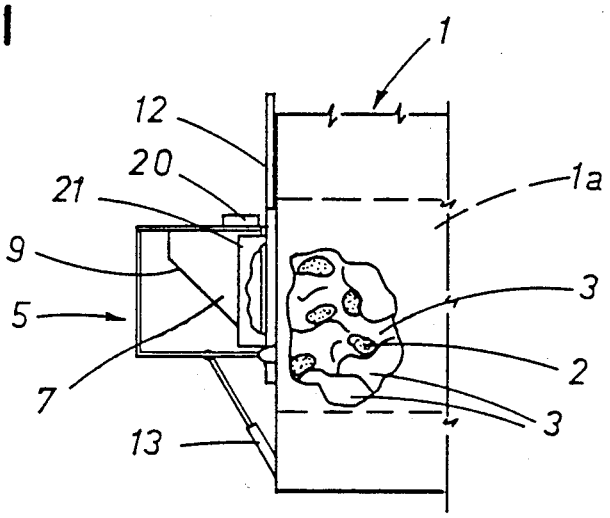
FIG. 6 shows the equipment of FIG. 5 in a further operating position.
Figure 5:
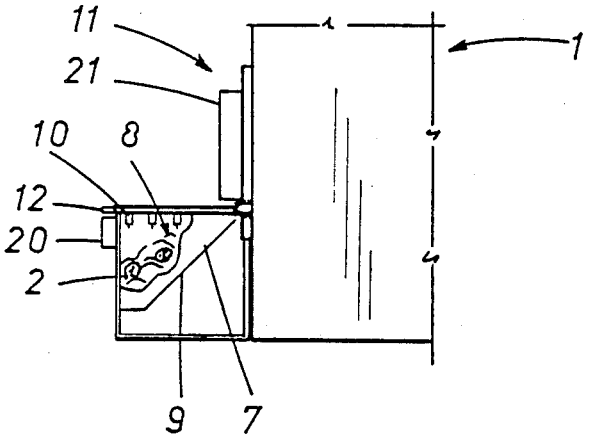
FIG. 5 shows a different embodiment of the equipment illustrated in FIGS. 2, 3 and 4, seen in one of the three operating positions.
Figure 8:
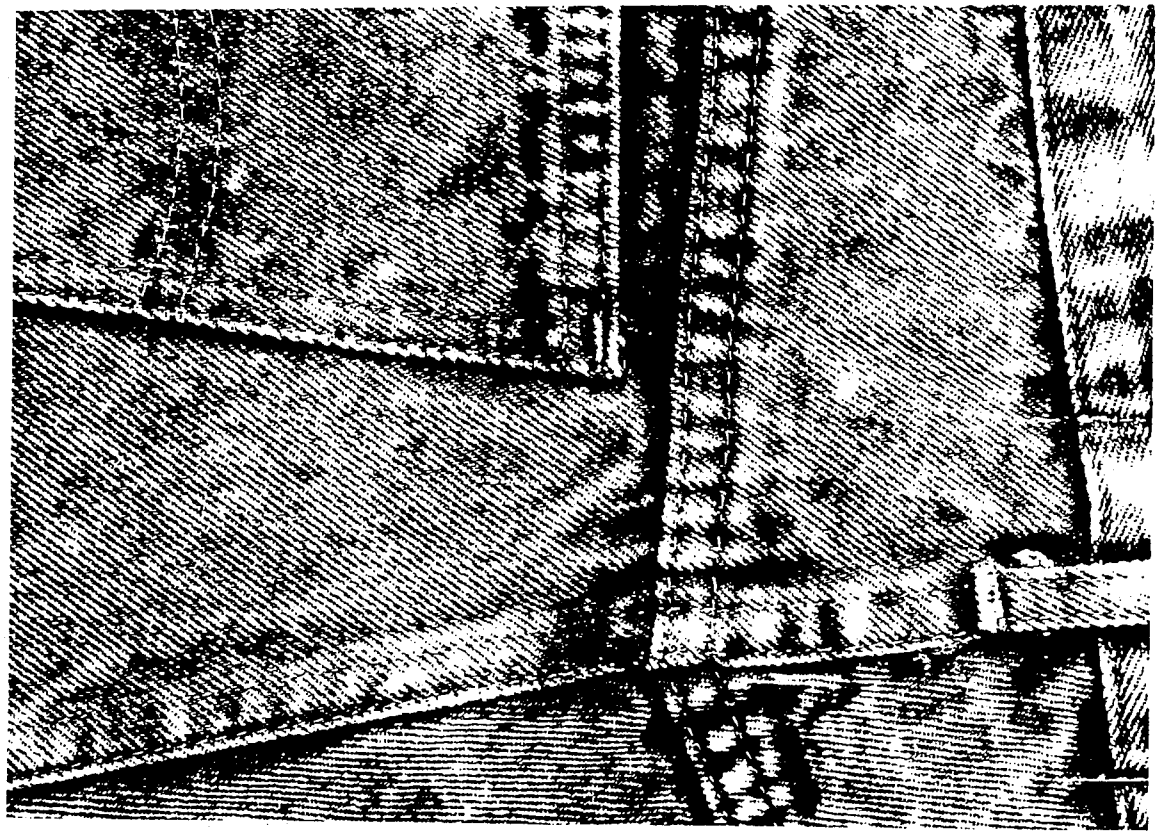
FIGS. 7 and 8 are examples of the effects produced on denim fabric by adoption of the method disclosed, illustrating an expanse of cloth without seams, and with seams jeans, respectively.
Figure 7:
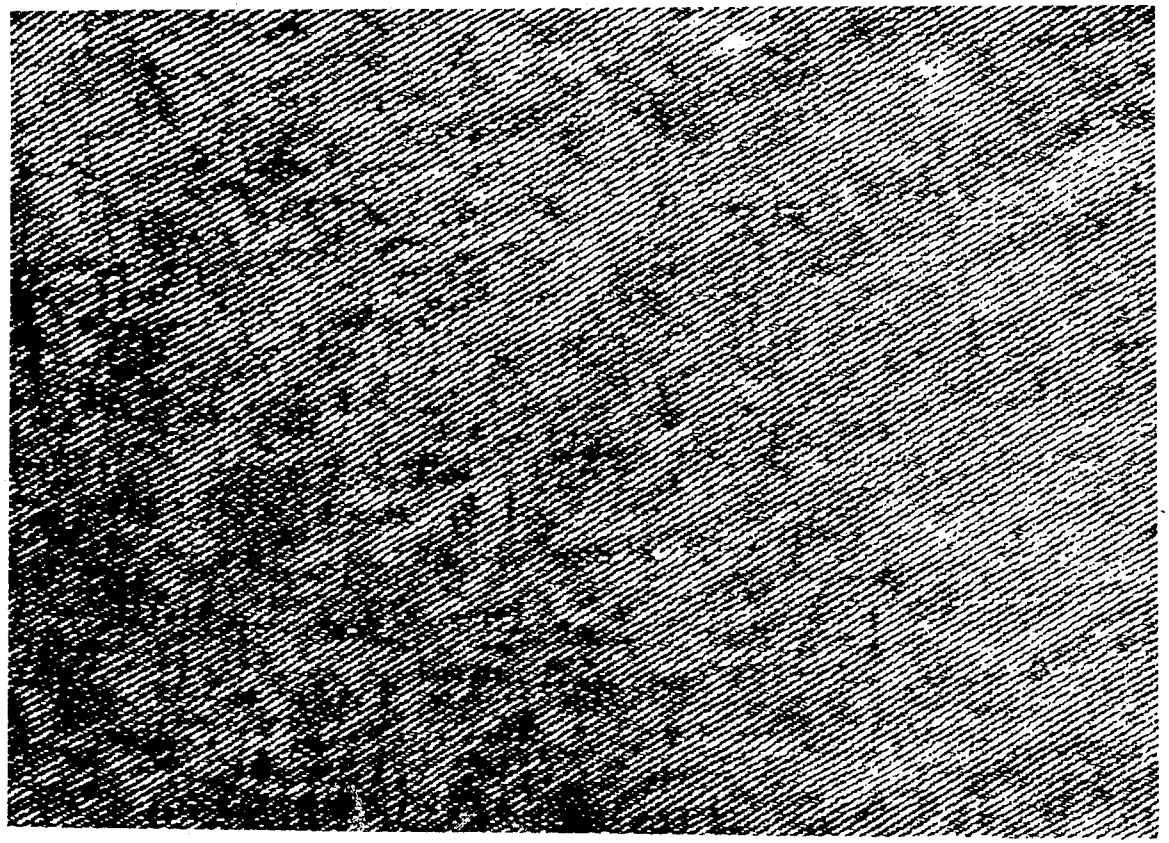

FIGS. 5 and 6 show an alternative embodiment of the equipment which is designed to reduce manning requirements. The bin 7 remains permanently associated with the actuator 13, whilst the riddle 12, instead of becoming separated totally from the bin, simply slides in relation to the open top 8 from a first position, in which the bin is uncovered, to a second position in which it fully occupies the open top; the first, clearly enough, is that in which the open top 8 of the bin 7 remains unobstructed and the granules 2 are afforded passage into the machine 1, whereas the second is that assumed for the purpose of recovering the granules 2 separated from cloth or garments 3 dumped by the machine on completion of the fading process.

What is claimed is:

1. A method of producing a random faded effect on cloth or a made-up garment which is in a wet or dry condition comprising the steps:

(a) impregnating granules of a coarse, permeable material having a high absorption characteristic with a bleaching agent;

(b) placing the impregnated granules and the cloth or garment, said cloth or garment being in a wet or dry condition, together in a rotatable drum;

(c) bleaching said cloth or garment in a dry state by dry-tumbling the cloth or garment and the granules together by rotating the drum for a period of time to produce a random faded effect on the cloth or garment;

(d) recovering or disposing of the granules following their separation from the randomly faded cloth or garment; and (e) neutralizing any residual bleaching agent held in the cloth or garment .

2. Method as in claim 1, wherein the granules are pumice, and the bleaching agent is a hypochlorite in solution.

3. Method as in claim 1, wherein the granules are a coarse paper-based material, and the bleaching agent is a hypochlorite in solution.

4. Method as in claim 1, wherein the period of time during which the granules and the cloth or garment are tumbled together is commensurate with the strength and the desired appearance of the faded cloth or garment, and wherein the granules produce a dual fading action that is a mechanical action due to the haphazard and abrasive contact between the coarse surface of the granules and the fibers of the cloth or garment, and a chemical action by reason of the contact between the cloth or garment and the bleaching agent with which the granules are impregnated, the dual fading action creating a visual effect of irregular patches or areas of dissimilar color shading distributed at random over the entire expanse of the treated cloth or garment.

5. A cloth or garment obtained by the method of claim 1, wherein the cloth or garment has non-uniform, irregular patches or areas of dissimilar color shading.

6. A method of producing a random faded effect on cloth fabric or a made-up garment which is in a wet or dry condition comprising:

(a) disposing the fabric or garment which is in said wet or dry condition in a chamber in dry contact with granules of a coarse, permeable material, said granules having been impregnated with a bleaching agent;

(b) bleaching said cloth or garment in a dry state by dry-tumbling said fabric or garment and granules together for a period of time sufficient to randomly fade the fabric or garment; and (c) separating the faded fabric or garment from the granules.

7. The method of claim 6 further comprising:

(d) removing residual bleaching agent contained in the fabric or garment.

8. The method of claim 7, wherein the removal is effected during a wash cycle.

9. The method of claim 7, wherein the removal comprises neutralizing said residual bleaching agent with a neutralizing agent.

10. The method of claim 6, wherein said granules comprise pumice stones.

11. The method of claim 6, wherein said bleaching agent is a hypochlorite.

12. The method of claim 11, wherein said hypochlorite is sodium hypochlorite.

13. The method of claim 6, wherein said fabric or garment is initially in a dry condition.

14. The faded made-up garmet produced by the method of claim 6.

15. The method of claim 2, wherein said hypochlorite is sodium hypochlorite.

16. The method of claim 3, wherein said hypochlorite is sodium hypochlorite.

17. The method of claim 6, wherein said bleaching agent is a liquid.

18. The method of claim 11, wherein said hypochlorite is in solution.

19. The method of claim 1, wherein said cloth or made-up garment is initially in a dry condition.

20. A faded cloth fabric produced by the method of claim 6.

* * * * *